US009550363B2

(12) United States Patent
Usui

(10) Patent No.: US 9,550,363 B2
(45) Date of Patent: Jan. 24, 2017

(54) INK-JET RECORDING APPARATUS

(71) Applicant: KYOCERA Document Solutions Inc., Osaka (JP)

(72) Inventor: Masato Usui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/040,595

(22) Filed: Feb. 10, 2016

(65) Prior Publication Data

US 2016/0243837 A1 Aug. 25, 2016

(30) Foreign Application Priority Data

Feb. 23, 2015 (JP) ..... 2015-032925

(51) Int. Cl.
*B41J 2/165* (2006.01)

(52) U.S. Cl.
CPC ..... *B41J 2/16538* (2013.01); *B41J 2/16508* (2013.01); *B41J 2/16511* (2013.01); *B41J 2/16544* (2013.01); *B41J 2/16585* (2013.01)

(58) Field of Classification Search
CPC ..... B41J 2/16538
See application file for complete search history.

(56) References Cited

U.S. PATENT DOCUMENTS

| | | | | |
|---|---|---|---|---|
| 5,729,258 | A | 3/1998 | Watabe et al. | 347/33 |
| 2004/0145624 | A1* | 7/2004 | Wouters | B41J 2/16538 347/33 |
| 2007/0103505 | A1* | 5/2007 | Takagi | B41J 2/16535 347/33 |
| 2014/0292917 | A1* | 10/2014 | Ito | B41J 2/16538 347/33 |

FOREIGN PATENT DOCUMENTS

| | | |
|---|---|---|
| JP | H 5-8403 A | 1/1993 |
| JP | 2013-67087 A | 4/2013 |

* cited by examiner

*Primary Examiner* — Justin Seo
*Assistant Examiner* — Roger W Pisha, II
(74) *Attorney, Agent, or Firm* — Stein IP, LLC

(57) ABSTRACT

An ink-jet recording apparatus includes a plurality of recording heads including a first recording head for ejecting black ink and a second recording head for ejecting a color ink; a rubber wipe blade; and a drive mechanism that moves the wipe blade along an ink ejecting surface and is able to move-up/down the wiper blade to approach or leave the ink ejecting surface. The wipe blade has: a first wipe blade that wipes purged ink on the ink ejecting surface of the first recording head; and a second wipe blade that wipes purged ink on the ink ejecting surface of the second recording head; wherein the first wipe blade is lower than the second wipe blade in rubber hardness, and the rubber hardness of the first wipe blade is 30° or higher to 45° or lower in ASKER C hardness.

6 Claims, 12 Drawing Sheets

INK-JET RECORDING APPARATUS

INCORPORATION BY REFERENCE

The present application is based on Japanese Patent Application No. 2015-32925 filed on Feb. 23, 2015, the contents of which are hereby incorporated by reference.

BACKGROUND

The present disclosure relates to an ink-jet recording apparatus that performs recording by ejecting ink onto a recording medium such a paper sheet.

As recording apparatuses such as facsimiles, copy machines, printers and the like, ink-jet recording apparatuses, which form an image by ejecting ink onto recording mediums such as paper, OHP sheets and the like, are widely used because they can form a high-definition image.

In such ink-jet recording apparatuses, generally, to prevent drying of ink in an ink ejecting nozzle whose opening is disposed through an ink ejecting surface of a recording head and clogging of the nozzle, the ink is forcibly pushed out (purged) from the nozzle. By means of this ink pushing-out, it is possible to discharge thickened ink, air bubbles, impurities and the like in the nozzle from the nozzle. Besides, the pushed-out ink dissolves again mists (ink residue) adhering to the ink ejecting surface.

And, a structure is employed, in which after pushing out the ink, the ink adhering to the ink ejecting surface (nozzle surface) is wiped by a blade-like wiper to perform a recovery operation of the recording head. The wiper is formed of a rubber-like elastic material, and the wiper is deformed elastically to be pushed against the ink ejecting surface, whereby it is possible to wipe the ink by making the wiper tightly contact the ink ejecting surface to prevent a gap from occurring between the ink ejecting surface and the wiper.

For example, an ink-jet recording apparatus is known, in which a blade for cleaning an ink ejecting surface of a recording head is formed of a material containing polyether polyurethane to obtain a high-quality image for a long period. Besides, an ink-jet recording apparatus is known, which includes a plurality of wipe blades that have different contact pressures on a nozzle surface and adjusts the contact pressures of the blades in accordance with dirty states and the like of the nozzle surface by switching the blades to be used.

SUMMARY

An ink-jet recording apparatus according to an aspect of the present disclosure is an ink-jet recording apparatus that includes a plurality of recording heads, a wipe blade, and a drive mechanism and is capable of executing a recovery operation of the recording head. The plurality of recording heads have each an ink ejecting surface which is provided with a nozzle region where an ejecting nozzle for ejecting water-based ink onto a recording medium is opened and is provided thereon with a water-repellent film, include a first recording head for ejecting black ink and a second recording head for ejecting a color ink other than the black ink. The wipe blade is formed of rubber and wipes purged ink which is pushed out forcibly from the ejecting nozzle to the ink ejecting surface. The drive mechanism moves the wipe blade along the ink ejecting surface and is able to move-up/down the wiper blade in a direction in which to approach or leave the ink ejecting surface. The wipe blade has a first wipe blade that wipes the purged ink which is pushed out to the ink ejecting surface of the first recording head, and a second wipe blade that wipes the purged ink which is pushed out to the ink ejecting surface of the second recording head; and the first wipe blade is lower than the second wipe blade in rubber hardness, and the rubber hardness of the first wipe blade is 30° or higher to 45° or lower in ASKER C hardness.

Still other objects of the present disclosure and specific advantages obtained by the present disclosure will become more apparent from the following detailed description of a preferred embodiment.

DETAILED DESCRIPTION

Figure 1:
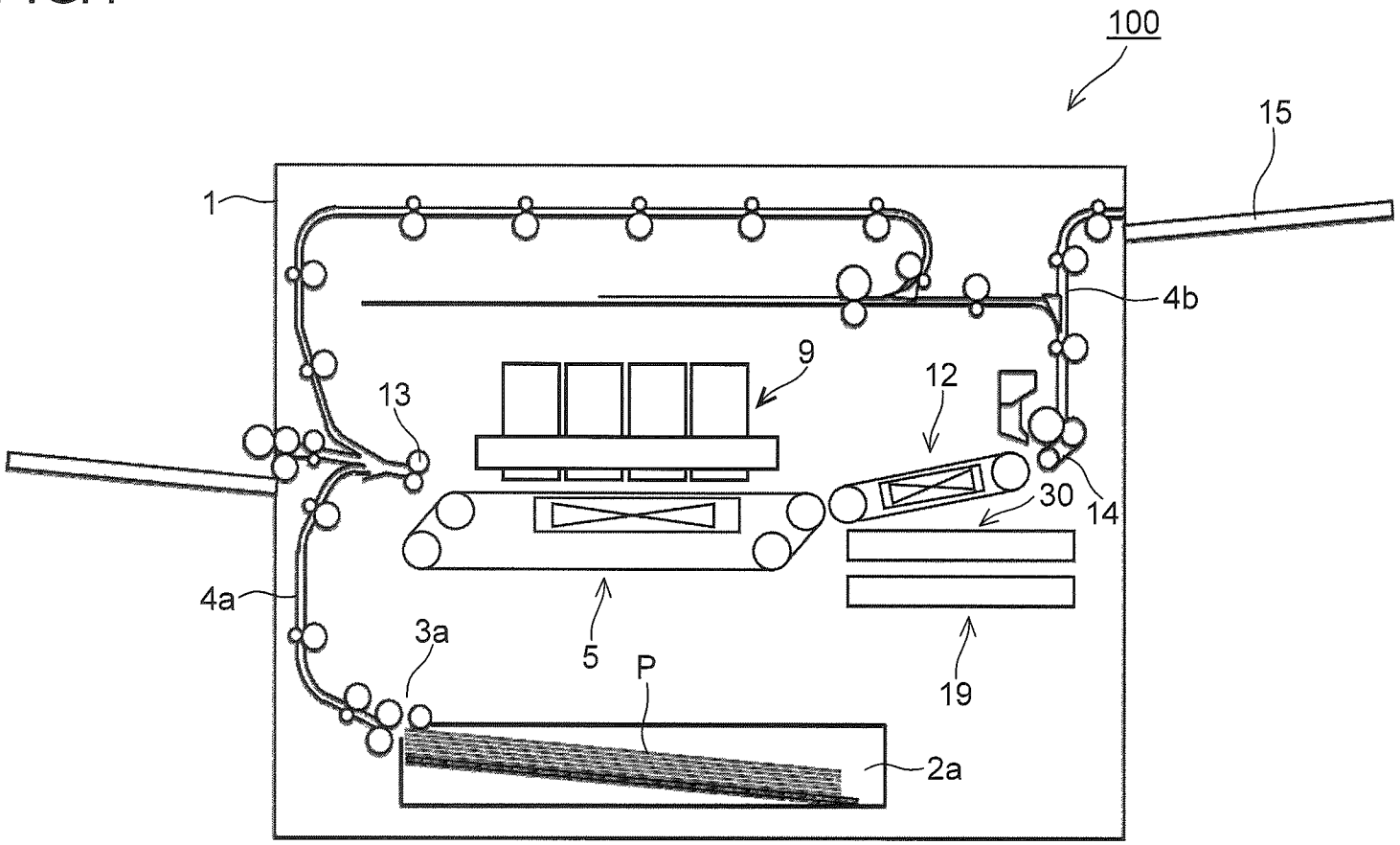
FIG. 1 is a view showing structure of an ink-jet printer according to an embodiment of the present disclosure.

Hereinafter, with reference to FIG. 1 to FIG. 19, an ink-jet printer 100 (ink-jet recording apparatus, hereinafter, sometimes called a printer 100) according to an embodiment of the present disclosure is described. As shown in FIG. 1, In the printer 100, a sheet feeding cassette 2*a* as a sheet storing portion is disposed in an internal lower portion of a printer main body 1. Sheets P as an example of recording mediums are stored in the sheet feeding cassette 2*a*. A sheet feeding device 3*a* is disposed on a downstream side of the sheet feeding cassette 2*a* in a sheet conveyance direction, that is, at a left upper position of the sheet feeding cassette 2*a* in FIG. 1. The sheet feeding device 3*a* separates and sends the sheets P one after another toward the left upper direction from the sheet feeding cassette 2*a* in FIG. 1.

Besides, the printer 100 includes therein a first sheet conveyance path 4*a*. The first sheet conveyance path 4*a* is located in a left upper side with respect to the sheet feeding cassette 2*a* in the sheet feeding direction. The sheet P sent from the sheet feeding cassette 2*a* is conveyed upward vertically by the first sheet conveyance path 4*a* along a side surface of the printer main body 1.

A registration roller pair 13 is disposed on a downstream end of the first sheet conveyance path 4*a* in the sheet conveyance direction. Further, a first belt conveyance portion 5 and a recording portion 9 are disposed at positions very close to a downstream side of the registration roller pair 13 in the sheet conveyance direction. The sheet P sent from the sheet feeding cassette 2*a* reaches the registration roller pair 13 through the first sheet conveyance path 4*a*. The registration roller pair 13 corrects oblique sending of the sheet P and sends the sheet P to the first belt conveyance portion 5 in accordance with a timing synchronized with an ink ejecting operation executed by the recording portion 9.

A second belt conveyance portion 12 is disposed on a downstream side (right side of FIG. 1) of the first belt conveyance portion 5 in the sheet conveyance direction. The sheet P, on which an ink image is recorded by the recording portion 9, is sent to the second belt conveyance portion 12 and the ink ejected to a surface of the sheet P is dried during passing through the second belt conveyance portion 12.

A decurler portion 14 is disposed near a right side surface of the printer main body 1 on a downstream side of the second belt conveyance portion 12 in the sheet conveyance direction. The sheet P, whose ink is dried in the second belt conveyance portion 12, is sent to the decurler portion 14, where a curl occurring in the sheet P is corrected by using a plurality of rollers arranged in a sheet width direction.

A second sheet conveyance path 4*b* is disposed on a downstream side (upper portion of FIG. 1) of the decurler portion 14 in the sheet conveyance direction. In a case where both-side recording is not performed, the sheet P passing through the decurler portion 14 is ejected from the second sheet conveyance path 4*b* to a sheet ejecting tray 15, which is disposed at an external position of the right side of the printer 100, via an ejecting roller pair.

Besides, a wipe unit 19 and a cap unit 30 are disposed under the second belt conveyance portion 12. When performing a purge described later, the wipe unit 19 moves horizontally under the recording portion 9, wipes ink pushed out from nozzles 18 (see FIG. 2) of recording heads 17*a*-17*c* described later, and collects the wiped ink. When capping an ink ejecting surface F (see FIG. 4) of the recording heads 17*a*-17*c*, the cap unit 30 moves horizontally under the recording portion 9, further moves upward to be mounted on a lower surface of the recording heads 17*a*-17*c*.

Figure 2:
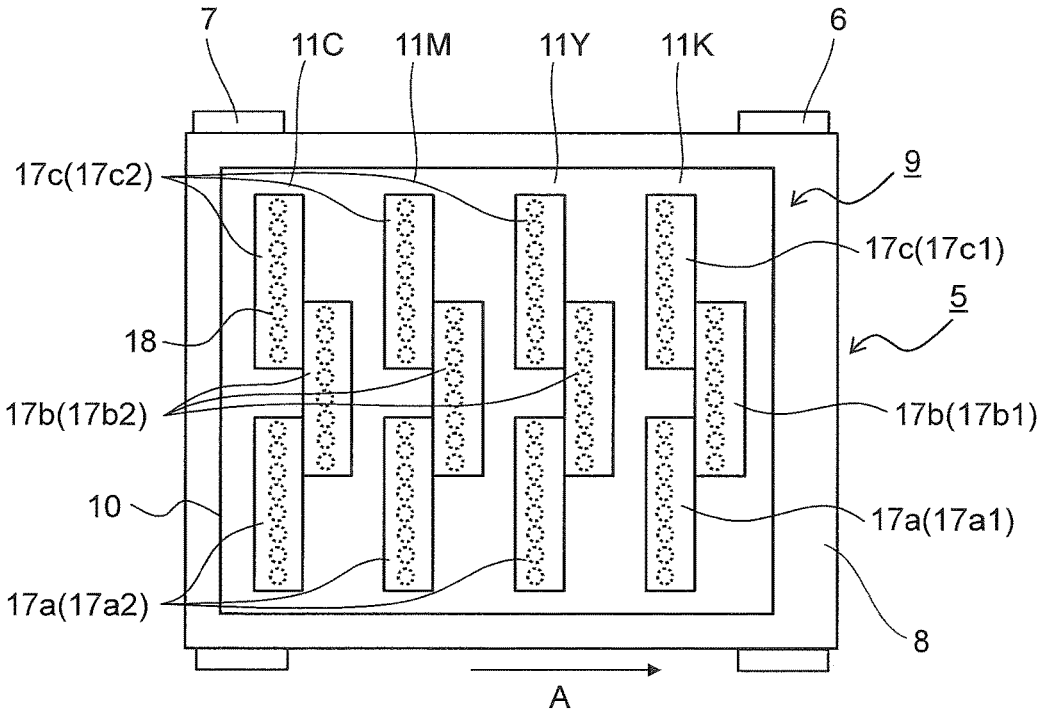
FIG. 2 is a view showing, from over, a first belt conveyance portion and a recording portion of the printer according to the embodiment of the present disclosure.
Figure 3:
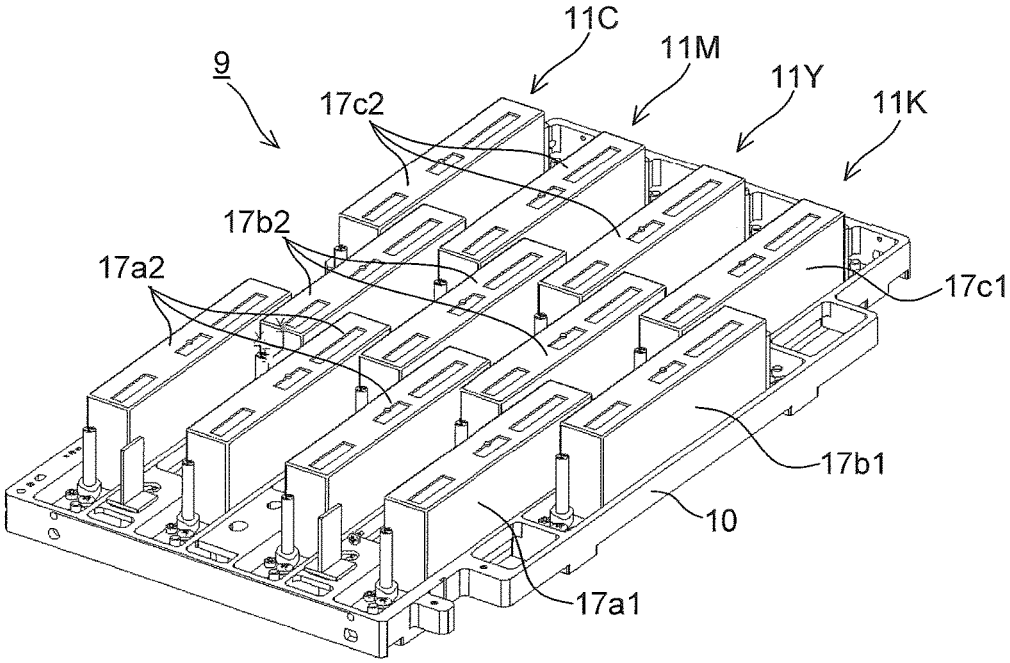
FIG. 3 is a view showing structure of the recording portion of the printer according to the embodiment of the present disclosure.

As shown in FIG. 2 and FIG. 3, the recording portion 9 includes a head housing 10, and line heads 11C, 11M, 11Y, and 11K held by the head housing 10. These line heads 11C-11K are supported at a height where a predetermined distance (e.g., 1 mm) is formed with respect to a conveyance surface of a first conveyance belt 8 mounted on a plurality of rollers that include a drive roller 6 and a driven roller 7. A plurality of the recording heads (here, three) 17*a*-17*c* are arranged in a staggering pattern along the sheet width direction (vertical direction of FIG. 2) perpendicular to the sheet conveyance direction. The line heads 11C-11K have a recording region larger than the width of the conveyed sheet P, and are able to eject water-based ink (hereinafter, simply called ink) from an ejecting nozzle 18 corresponding to a printing position to the sheet P conveyed by the first conveyance belt 8. Hereinafter, the recording heads 17*a*-17*c* of the line head 11K, which eject black ink, are also called first recording heads 17*a*1-17*c*1. Besides, the recording heads 17*a*-17*c* of the line heads 11C-11Y, which eject cyan, magenta, and yellow inks, are also called second recording heads 17*a*2-17*c*2.

Figure 4:
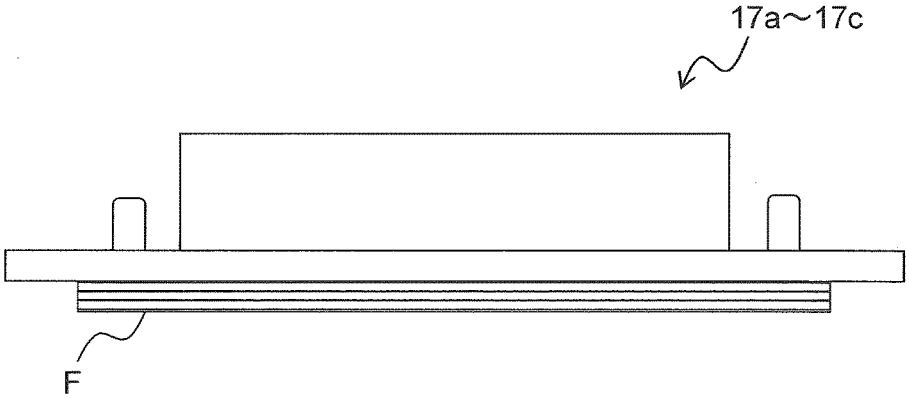
FIG. 4 is a view showing structure of a recording head that composes a line head of the recording portion of the printer according to the embodiment of the present disclosure.
Figure 5:
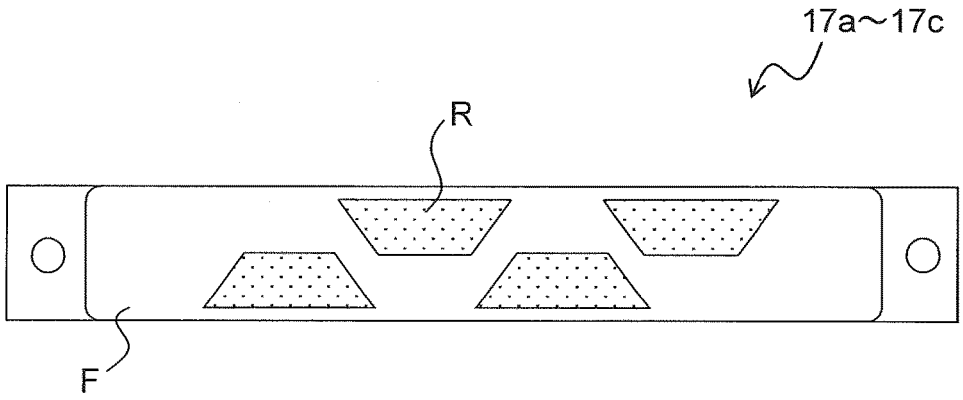
FIG. 5 is a view showing, from an ink ejecting surface side, the recording head of the printer according to the embodiment of the present disclosure.

As shown in FIG. 5, the ink ejecting surface F (see FIG. 4) of the recording heads 17*a*-17*c* is provided with a nozzle region R where many ejecting nozzles 18 are arranged. Besides, a water-repellent film (not shown) is formed on the ink ejecting surface F. As materials of the water-repellent film, there are fluoroalkylsilane, alkane having a fluoroalkyl group, organic compounds such as carboxylic acid, alcohol, amine and the like having fluorine atoms, organic silicon compounds having a dimethylsiloxane skeleton, organic silicon compounds having an alkylsiloxane group and the like. As methods for forming the water-repellent film, there are, for example, a method for depositing a water-repellent material under vacuum, a method for dissolving a water-repellent material in a suitable solvent and applying and the like. In the meantime, the recording heads 17*a*-17*c* have the same shape and structure. Accordingly, FIG. 4 and FIG. 5 represent the recording heads 17*a*-17*c* by means of one drawing.

The groups of the recording heads 17*a*-17*c* composing each line head 11C-11K are respectively supplied with four different color inks (cyan, magenta, yellow, and black), which are respectively stored in ink tanks (not shown), for the line heads 11C-11K.

In accordance with image data received from an external computer, each recording head 17*a*-17*c* ejects ink from the ejecting nozzles 18 onto the sheet P conveyed with attracted and held by the conveyance surface of the first conveyance belt 8. In this way, a color image composed of the mixed four color inks of cyan, magenta, yellow and black is formed on the sheet P on the first conveyance belt 8.

Besides, to prevent defective ink ejecting caused by drying or clogging of the recording heads 17*a*-17*c*, a purge is executed to push out highly viscous ink present in the ejecting nozzles 18 from the ejecting nozzles 18 of the recording heads 17*a*-17*c* and thereby to prepare for the next printing operation. For example, at a printing start time after a long-time halt, the ink is pushed out from the ejecting nozzles 18 of all the recording heads 17*a*-17*c*. Besides, between printing operations, the ink is pushed out from some of the ejecting nozzles 18 of the recording heads 17*a*-17*c* whose ink ejecting amount is equal to or less than a standard value.

Figure 6:
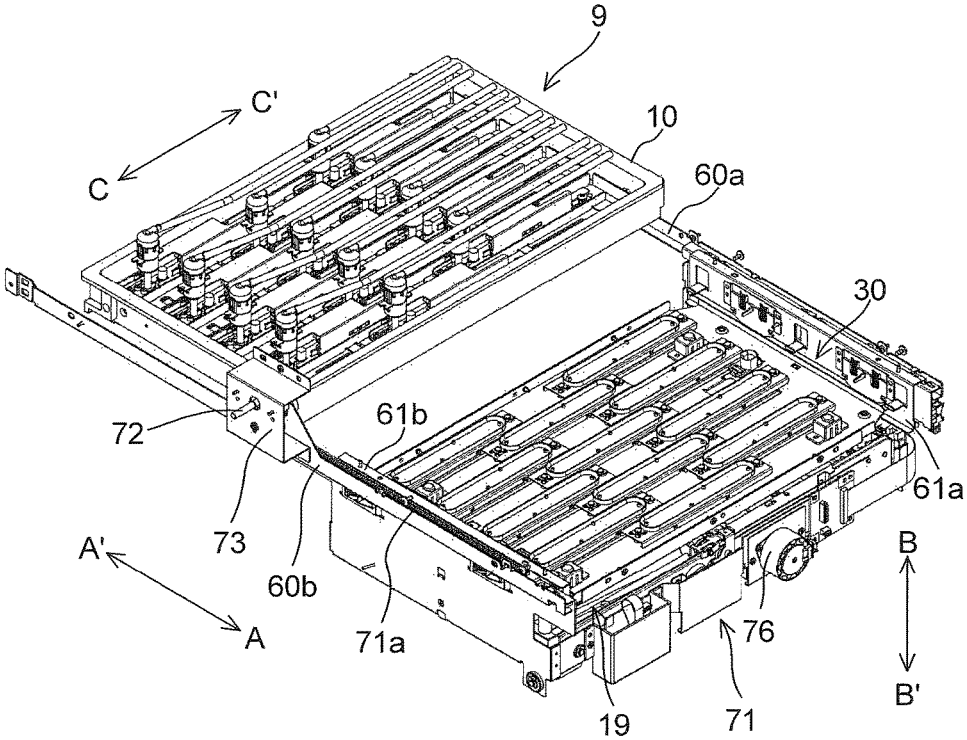
FIG. 6 is a view showing structure of the recording portion, cap unit, wipe unit and the like of the printer according to the embodiment of the present disclosure.

As shown in FIG. 6, two guide rails 60*a*, 60*b* are fixed under the recording portion 9 along both end portions parallel with the sheet conveyance direction (arrow A direction). A pair of guide plates 61*a*, 61*b* are fixed to the guide rails 60*a*, 60*b*, respectively, and side end edges of the cap unit 30 are supported by lower end portions of the guide plates 61*a*, 61*b*. Besides, a carriage 71 is slidably supported by the guide rails 60*a*, 60*b*, and the wipe unit 19 is placed on the carriage 71.

The cap unit 30 can reciprocate between a first position right under the recording portion 9 and a second position (position in FIG. 6) evacuated from the first position in a horizontal direction (arrow A direction). The cap unit 30 moves upward at the first position to cap the recording heads 17*a*-17*c*.

Figure 7:
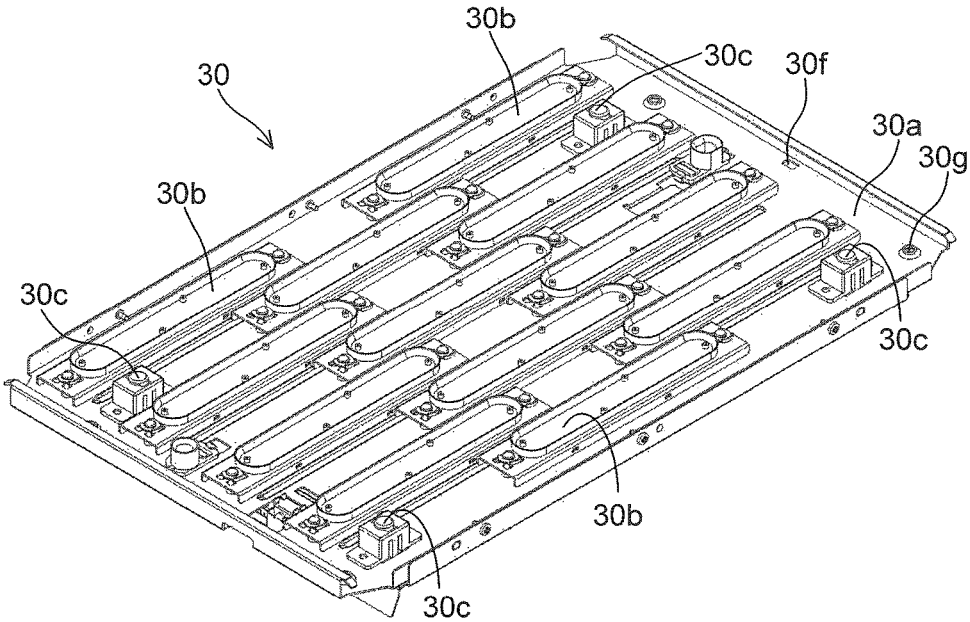
FIG. 7 is a view showing structure of the cap unit of the printer according to the embodiment of the present disclosure.

Specifically, as shown in FIG. 7, the cap unit 30 includes a sheet-metal cap tray 30*a*, 12 concave-like cap portions 30*b* disposed on an upper surface of the cap tray 30*a*, and 4 height-direction positioning protrusions 30*c*.

The cap portions 30*b* are disposed at positions corresponding to the recording heads 17*a*-17*c*. According to this, the cap unit 30 moves upward at the first position, whereby each cap portion 30*b* caps the ink ejecting surface F of each recording head 17*a*-17*c*. When the cap unit 30 is moved up toward the recording portion 9 to cap the recording heads 17*a*-17*c*, the height-direction positioning protrusion 30*c* abuts the housing 10 of the recording head 9 and thereby keeps a constant contact state between the cap portion 30*b* and the ink ejecting surface F.

As shown in FIG. 6, the wipe unit 19 can reciprocate between the first position right under the recording portion 9 and the second position evacuated from the first position in the horizontal direction (arrow A direction). The wipe unit 19 moves upward at the first position to perform a wiping operation described later.

Specifically, a drive motor 72 for moving the carriage 71 in an AA' direction, a line of gears (not shown) engaging with the drive motor 72 and rack teeth 71*a* of the carriage 71, and a cover member 73 for covering them are mounted outside the guide rail 60*b*. The drive motor 72 rotates forward, whereby the line of gears rotate, and the carriage 71 and the wipe unit 19 move from the second position to the first position. In the meantime, the drive motor 72, the line of gears and the like compose a wipe unit moving mechanism that moves the wipe unit 19 in the horizontal direction.

Figure 8:
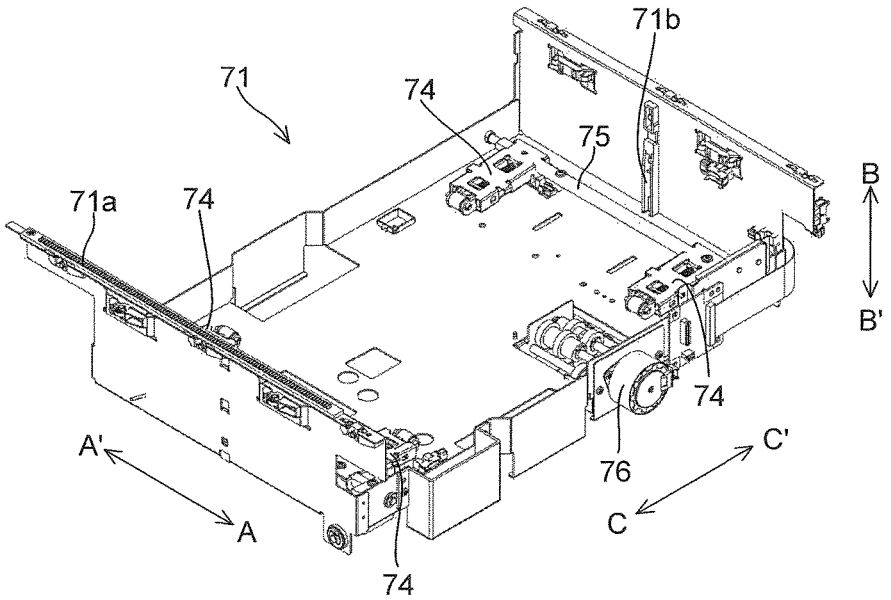
FIG. 8 is a view showing structure of a carriage of the printer according to the embodiment of the present disclosure.
Figure 9:
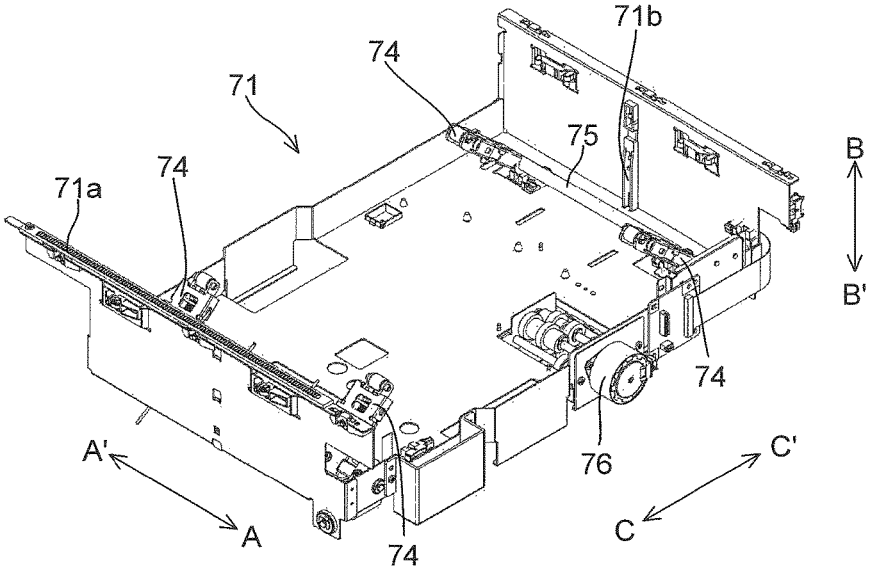
FIG. 9 is a view showing structure of the carriage of the printer according to the embodiment of the present disclosure.

Besides, as shown in FIG. 8 and FIG. 9, at four corners of the carriage 71, support arms 74 are disposed which support the wipe unit 19 from a lower surface side and are swingable (rise and fall). The support arms 74 adjacent to each other in the AA' direction are connected to each other by a rotary shaft 75. Besides, a wipe moving-up/down motor 76 for swinging the support arms 74, a line of gears (not shown) that engage with gears of the wipe moving-up/down motor 76 and rotary shafts 75 and the like are mounted outside the carriage 71. The wipe moving-up/down motor 76 rotates forward, whereby the line of gears and the like rotate, and the rotary shafts 75 pivot, whereby the support arms 74 swing (rise). In this way, the wipe unit 19 moves up. In the meantime, the wipe moving-up/down motor 76, the line of gears, the rotary shafts 75, the support arms 74 and the like compose a wipe moving-up/down mechanism that moves the wipe unit 19 in a vertical direction (arrow BB' direction). Besides, an inner surface of the carriage 71 is provided with guide grooves 71*b* which extend in the vertical direction, and the wipe unit 19 moves up and down along the guide grooves 71*b*.

Figure 10:
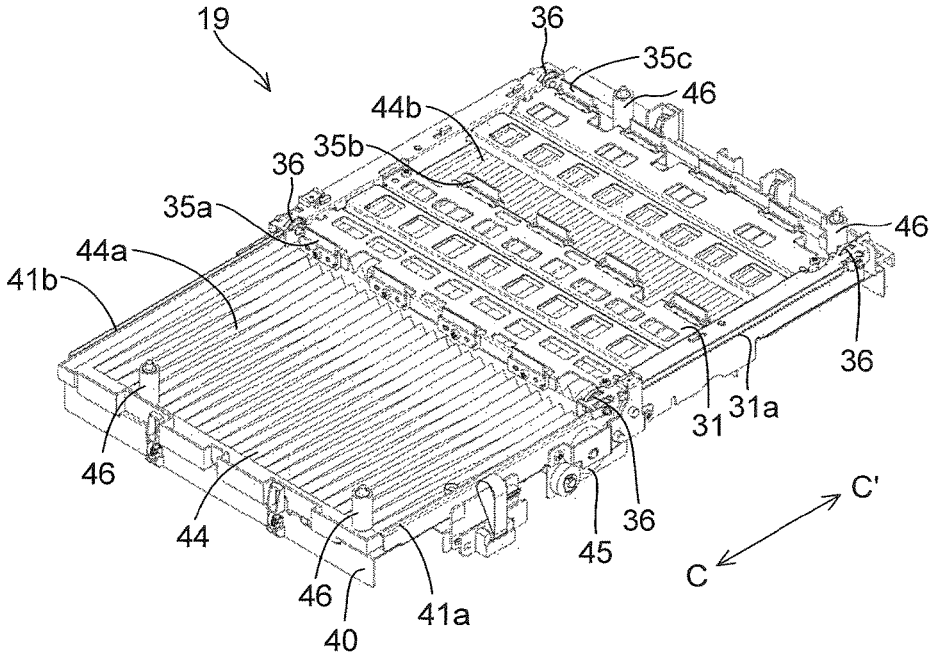
FIG. 10 is a view showing structure of the wipe unit of the printer according to the embodiment of the present disclosure.
Figure 11:
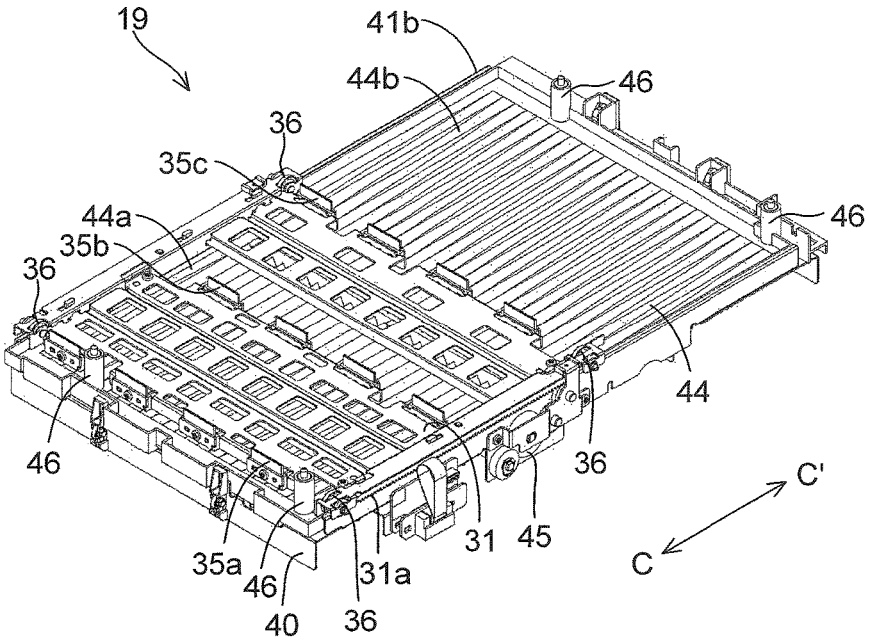
FIG. 11 is a view showing structure of the wipe unit of the printer according to the embodiment of the present disclosure.

As shown in FIG. 10 and FIG. 11, the wipe unit 19 is composed of a substantially rectangular wiper carriage 31 to which a plurality of wipers (wipe blades) 35*a*-35*c* are fixed and a support frame 40 that supports the wiper carriage 31.

Opposing end edges of an upper surface of the support frame 40 are provided with rail portions 41*a*, 41*b*. Rollers 36 disposed at four corners of the wiper carriage 31 abut the rail portions 41*a*, 41*b*, whereby the wiper carriage 31 is supported slidably in an arrow CC' direction with respect to the support frame 40.

A wiper carriage moving motor 45 for moving the wiper carriage 31 in the horizontal direction (arrow CC' direction), and a line of gears (not shown) that engage with the wiper carriage moving motor 45 and rack teeth (not shown) of the wiper carriage 31 are mounted outside the support frame 40. The wiper carriage moving motor 45 rotates forward or backward, whereby the line of gears rotate forward or backward and the wiper carriage 31 reciprocates in the horizontal direction (arrow CC' direction). In the meantime, the wiper carriage moving motor 45, the line of gears and the like compose a wipe moving mechanism that moves the wipers 35*a*-35*c* along the ink ejecting surfaces F of the recording heads 17*a*-17*c*.

The wipers 35*a*-35*c* are each a rubber member formed of EPDM, for example, for wiping the ink pushed out from the ejecting nozzles 18 of each recording head 17*a*-17*c*. The wipers 35*a*-35*c* are pressed, from a substantially vertical direction, against a wipe start position located outside the nozzle region R (see FIG. 5) from which the ejecting nozzle 18 is exposed, and wipe the ink ejecting surface F including the nozzle regions R in a predetermined direction (arrow C direction in FIG. 10) by means of the movement of the wiper carriage 31.

The four wipers 35*a* are disposed at substantially equal intervals, likewise, also the four wipers 35*b* and the four wipers 35*c* are disposed at substantially equal intervals. The wipers 35*a*, 35*c* are disposed at positions corresponding to the left and right recording heads 17*a*, 17*c* (see FIG. 3) that compose each line head 11C-11K. Besides, the wiper 35*b* is disposed at a position corresponding to the central recording head 17*b* (see FIG. 3) that composes each line head 11C-11K, and is deviated and fixed, with respect to the wipers 35*a*, 35*c*, by a predetermined distance in a direction perpendicular to the moving direction (arrow CC' direction) of the wiper carriage 31.

Height-direction positioning protrusions 46 are disposed at four places of the upper surface of the support frame 40. When the support frame 40 is moved up toward the recording portion 9 to perform the wipe operation for the ink ejecting surfaces F of the recording heads 17*a*-17*c* by means of the wipers 35*a*-35*c*, the height-direction positioning protrusions 46 abut the housing 10 of the recording head 9 and thereby keep a constant contact state between the wipers 35*a*-35*c* and the ink ejecting surfaces F.

The upper surface of the support frame 40 is provided with an ink collection tray 44 for collecting the waste ink that is wiped from the ink ejecting surfaces F by the wipers 35*a*-35*c* and gathered by the cleaning mechanism 80 described later. A substantially central portion of the ink collection tray 44 is provided with an ink discharge hole (not shown) and tray surfaces 44*a*, 44*b* on both sides of the ink discharge hole have a downward gradient toward the ink discharge hole. The waste ink, which is wiped from the ink ejecting surfaces F by the wipers 35*a*-35*c* and falls onto the tray surfaces 44*a* and 44*b*, flows to the ink discharge hole (not shown). Thereafter, the waste ink is collected by a waste ink collection tank (not shown) via an ink collection path (not shown) that is connected to the ink discharge hole.

Next, a recovery operation of the recording heads 17*a*-17*c* of the printer 100 according to the present embodiment is described.

Figure 12:
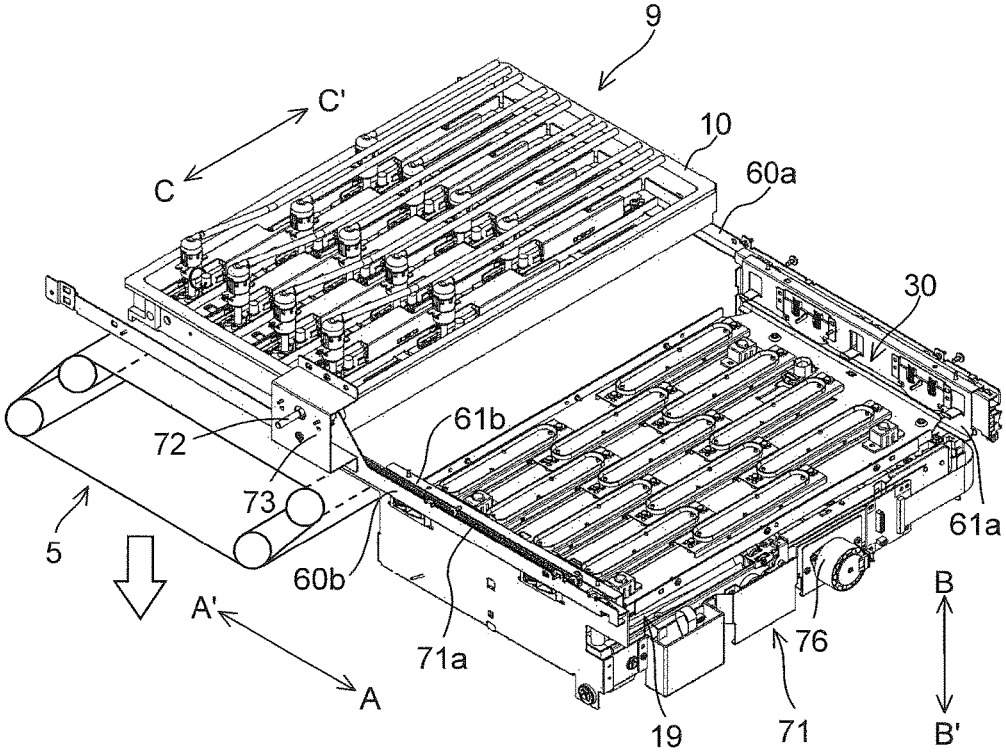
FIG. 12 is a view showing a state in which the first belt conveyance portion of the printer according to the embodiment of the present disclosure descends.
Figure 13:
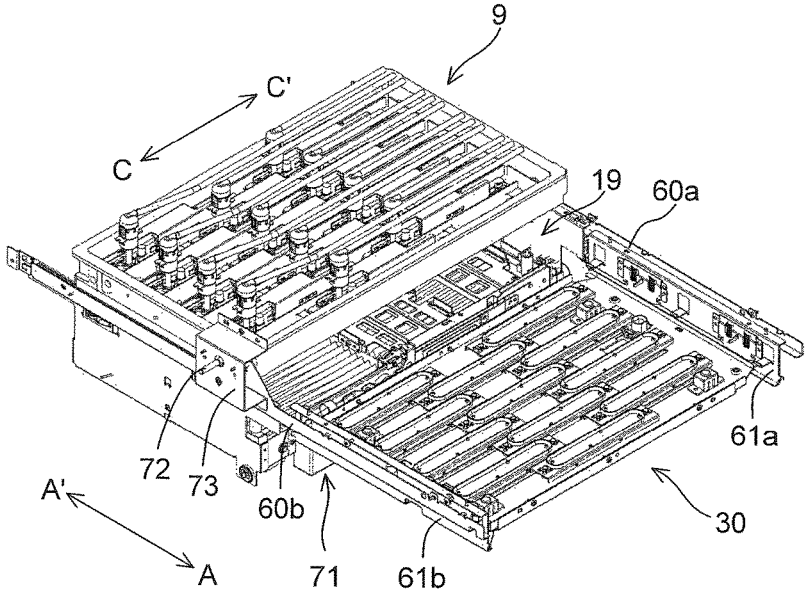
FIG. 13 is a view showing a state in which the wipe unit of the printer according to the embodiment of the present disclosure moves to a first position.

In a case where a recovery process of the recording heads 17*a*-17*c* is performed by means of the wipe unit 19, as shown in FIG. 12, the first belt conveyance portion 5, which is disposed to oppose a lower surface of the recording portion 9, is moved down. And, as shown in FIG. 13, the wipe unit moving mechanism moves the wipe unit 19 from the second position to the first position with the cap unit 30 left at the second position.

And, prior to the wiping operation, the ink is supplied to the recording heads 17*a*-17*c*. The supplied ink 22 is forcibly pushed out (purged) from the ejecting nozzles 18. Because of this purge operation, thickened ink, foreign matter, and air bubbles in the ejecting nozzles 18 are discharged, and the recording heads 17*a*-17*c* can be recovered.

Figure 14:
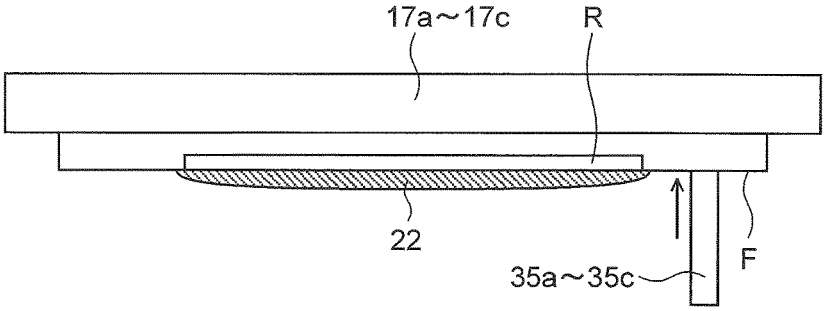
FIG. 14 is a view showing a state in which a wiper of the printer according to the embodiment of the present disclosure is pressed against a wipe start position of an ink ejecting surface of the recording head.

Next, the wiping operation for wiping the ink 22 discharged to the ink ejecting surface F is performed. Specifically, as shown in FIG. 14, the wipe moving-up/down mechanism moves up the wipe unit 19 and thereby presses the wipers 35*a*-35*c* against the wipe start positions of the ink ejecting surfaces F of the recording heads 17*a*-17*c*.

Figure 15:
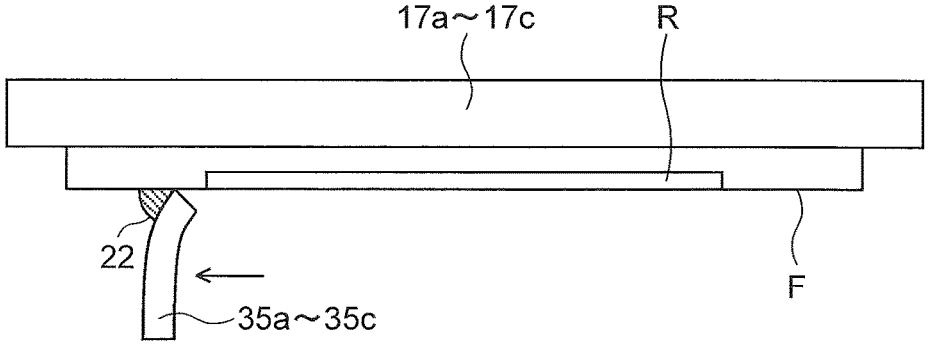
FIG. 15 is a view showing a state in which purged ink, which is pushed out to the ink ejecting surface of the recording head, is being wiped by the wiper of the printer according to the embodiment of the present disclosure.

And, the wiper carriage moving motor 45 (see FIG. 10) moves the wiper carriage 31 horizontally in the C direction. In this way, as shown in FIG. 15, the wipers 35*a*-35*c* wipe the ink 22 pushed out to the ink ejecting surfaces F of the recording heads 17*a*-17*c*.

After the wipers 35*a*-35*c* move to a downstream-side end portion of the ink ejecting surfaces F of the recording heads 17*a*-17*c*, the wipe moving-up/down mechanism moves down the wiper carriage 31. In this way, the wipers 35*a*-35*c* are evacuated downward from the ink ejecting surfaces F of the recording heads 17*a*-17*c*.

Thereafter, the wipe unit moving mechanism moves the wipe unit 19 in the arrow A direction from the first position. In this way, as shown in FIG. 12, the wipe unit 19 is disposed at a predetermined position (second position) right under the cap unit 30.

Next, the operation of mounting the cap unit 30 onto the recording heads 17*a*-17*c* of the printer 100 according to the present embodiment is described.

Figure 16:
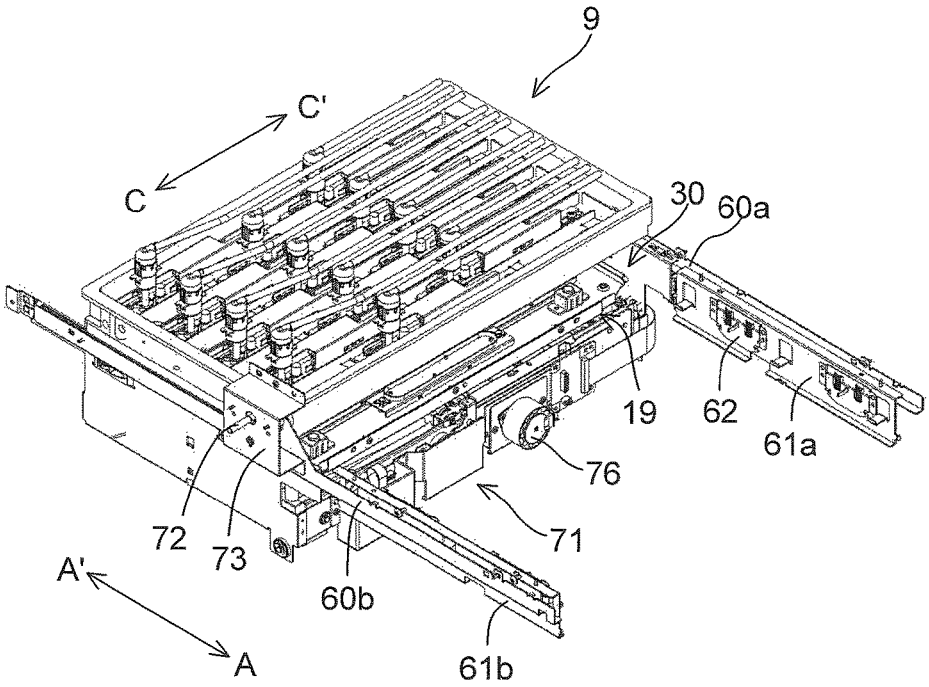
FIG. 16 is a view showing a state in which the cap unit and the wipe unit of the printer according to the embodiment of the present disclosure move to the first position.

In the case where the recording heads 17*a*-17*c* are capped by the cap unit 30, as shown in FIG. 12, the first belt conveyance portion 5, which is disposed to oppose the lower surface of the recording portion 9, is moved down. And, as shown in FIG. 16, the wipe unit moving mechanism moves the wipe unit 19 and the cap unit 30 from the second position to the first position with the cap unit 30 disposed on the wipe unit 19. Thereafter, the wipe moving-up/down mechanism moves up the wipe unit 19 and the cap unit 30 and thereby mounts the cap unit 30 (cap portion 30*b*) onto the recording heads 17*a*-17*c*.

As described above, as to the recording heads 17*a*-17*c* of the line head 11K which eject the black ink, in a case where the wipe operation, in which the black ink pushed out to the ink ejecting surfaces F is wiped by the wipers 35*a*-35*c*, is repeated, carbon black contained in the ink is rubbed against the ink ejecting surfaces F, whereby the water-repellent films formed on the ink ejecting surfaces F are scraped. As a result of this, the ink becomes prone to adhere around the ejecting nozzle 18 of the ink ejecting surface F, and deterioration (landing position deviation) in straight traveling of the ink occurs.

To alleviate the scrape of the water-repellent film caused by the wipers 35*a*-35*c*, it is conceivable to lower a contact pressure of the wipers 35*a*-35*c* on the ink ejecting surface F by lowering the rubber hardness of the wipers 35*a*-35*c*. However, in a case where the ink ejecting surface F is wiped by using the wipers 35*a*-35*c* having a low rubber hardness, an ink wipe effect degrades, and some amount of the purged ink is not wiped and left on the ink ejecting surface F.

Here, as to the line head 11K, comparing an influence given to an image by the deterioration in the water-repellent film in a case where the wiper having a high rubber hardness is used and an influence given to the image by the occurrence of the remaining of not-wiped purged ink in a case where the wiper having a low rubber hardness is used with each other, the landing position deviation due to the deterioration in the water-repellent film gives a greater influence to the image than an influence given by the remaining of the not-wiped purged ink.

On the other hand, the line heads 11C-11Y use organic pigments as the inks of cyan, yellow, and magenta. Accordingly, during the wipe period of the purged ink by the wipers 35*a*-35*c*, the water-repellent film is not scraped. Because of this, it is preferable to alleviate the remaining of the not-wiped purged ink by using the wipers 35*a*-35*c* that have a high rubber hardness.

Because of this, in the present embodiment, the rubber hardness of the wipers 35*a*-35*c* (hereinafter, called first wipers 35*a*1-35*c*1) for wiping the ink ejecting surface F of the first recording heads 17*a*1-17*c*1 of the line head 11K is made lower than the rubber hardness of the wipers 35*a*-35*c* (hereinafter, called second wipers 35*a*2-35*c*2) for wiping the ink ejecting surface F of the second recording heads 17*a*2-17*c*2 of each of the line heads 11C-11Y.

Besides, if the rubber hardness of the first wipers 35*a*1-35*c*1 is too high, the water-repellent film becomes prone to be scraped, and if the rubber hardness is too low, the ink on the ink ejecting surface F becomes prone to remain without being wiped. Because of this, the rubber hardness of the first wipers 35*a*1-35*c*1 is set at 30° or higher to 45° or lower. In the meantime, the "rubber hardness" described in the present specification refers to the ASKER C hardness defined by the Society of Rubber Industry, Japan Standard (SRIS).

Figure 17:
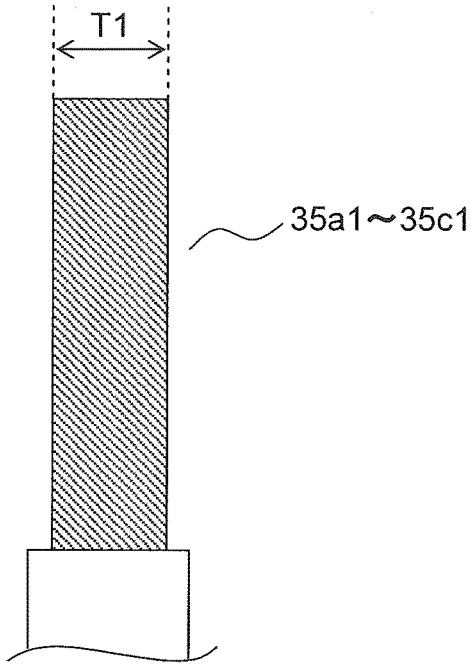
FIG. 17 is a view showing a first wiper from a direction perpendicular to a wipe direction (arrow A direction).
Figure 18:
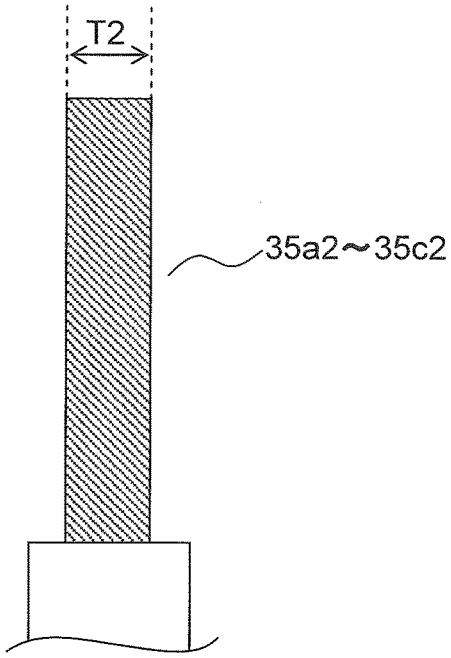
FIG. 18 is a view showing a second wiper from the direction perpendicular to the wipe direction (arrow A direction).

Besides, in a case where the same-shaped wipers 35*a*-35*c* are made to contact the ink ejecting surface F at the same contact pressure, a lower rubber hardness leads to a lower contact pressure (linear pressure). Because of this, as shown in FIG. 17 and FIG. 18, a thickness T1 of the first wipers 35*a*1-35*c*1 is formed to be thicker than a thickness T2 of the second wipers 35*a*2-35*c*2, whereby the contact pressure of the first wipers 35*a*1-35*c*1 on the ink ejecting surface F and the contact pressure of the second wipers 35*a*2-35*c*2 on the ink ejecting surface F are set at substantially the same contact pressure. To alleviate the remaining of the not-wiped purged ink, it is preferable to set the contact pressures of the first wipers 35*a*1-35*c*1 and second wipers 35*a*2-35*c*2 on the ink ejecting surface F at 30 N/m or higher.

According to the above structure, as to the first recording heads 17*a*1-17*c*1 that eject the black ink, the wiping operation is performed by using the first wipers 35*a*1-35*c*1 that have the low rubber hardness. As a result of this, the scrape of the water-repellent film of the ink ejecting surface F caused by the repeated wiping operations is alleviated.

Accordingly, it is possible to effectively alleviate the degradation in the image quality caused by the landing position deviation of the ejected ink.

Besides, as to the second recording heads 17*a*2-17*c*2 that eject the inks of cyan, yellow, and magenta, the wiping operation is performed by using the second wipers 35*a*2-35*c*2 that have the high rubber hardness. As a result of this, the occurrence of remaining not-wiped purged ink is alleviated. Accordingly, it is possible to effectively alleviate a disadvantage that the ink gradually adheres to the ink ejecting surface F because of the repeated wiping operations, drips from the ink ejecting surface F, and the dripping ink contacts the sheet to dirty a print surface. It is preferable to set the rubber hardness of the second wipers 35*a*2-35*c*2 at 50° or higher in the ASKER C hardness.

In the meantime, here, the contact pressure of the first wipers 35*a*1-35*c*1 on the ink ejecting surface F and the contact pressure of the second wipers 35*a*2-35*c*2 on the ink ejecting surface F are set at substantially the same contact pressure. However, as described above, in the second recording heads 17*a*2-17*c*2, during the wiping period by the second wipers 35*a*2-35*c*2, the scrape of the water-repellent film of the ink ejecting surface F does not occur. Because of this, the contact pressure of the second wipers 35*a*2-35*c*2 on the ink ejecting surface F may be set higher than the contact pressure of the first wipers 35*a*1-35*c*1 on the ink ejecting surface F.

Figure 19:
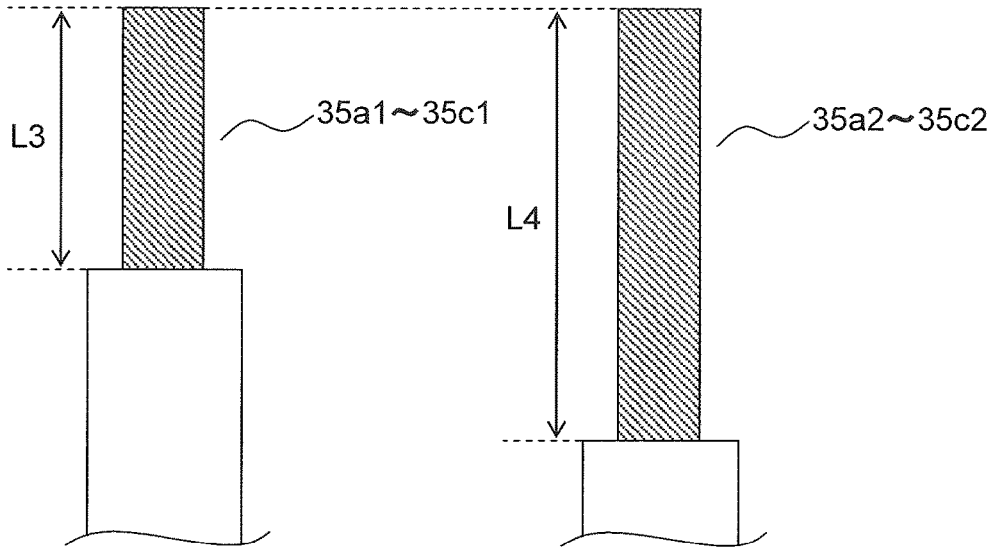
FIG. 19 is a view showing an example, in which an extension length of the first wiper is shorter than an extension length of the second wiper, from the direction perpendicular to the wipe direction (arrow A direction).

Besides, instead of forming the thickness T1 of the first wipers 35*a*1-35*c*1 to be larger than the thickness T2 of the second wipers 35*a*2-35*c*2, as shown in FIG. 19, a protrusion length (length from the proximal end portion supported by the wiper carriage 31 to the tip end portion contacting the ink ejecting surface F) L3 of the first wipers 35*a*1-35*c*1 is formed to be shorter than a protrusion length L4 of the second wipers 35*a*2-35*c*2, whereby it is also possible to set the contact pressures on the ink ejecting surface F at substantially the same contact pressure. In this case, height positions of the tip ends of the first wipers 35*a*-35*c* and second wipers 35*a*-35*c* are set at the same level in such a way that when making the wipe unit 19 ascend to press the wipers 35*a*-35*c* against the wipe start position of the ink ejecting surface F of the recording heads 17*a*-17*c*, the first wipers 35*a*1-35*c*1 and the second wipers 35*a*2-35*c*2 are pressed against the ink ejecting surface F at the same time.

Besides, the present disclosure is not limited to the above embodiment, and it is possible to make various modifications without departing from the spirit of the present disclosure. For example, it is possible to use other conventionally known drive mechanisms as the wipe unit moving mechanism composed of the drive motor 72, line of gears and the like, the wipe moving-up/down mechanism composed of the wiper moving-up/down motor 76, line of gears, rotary shaft 75, support arm 74 and the like, and the wipe moving mechanism composed of the wiper carriage moving motor 45, line of gears and the like.

Besides, it is possible to suitably set the number of ejecting nozzles 18 of the recording heads 17*a* to 17*c*, the nozzle interval and the like in accordance with the specifications of the printer 100. Besides, also the number of recording heads is not especially limited, and for example, it is also possible to dispose the recording head 17 one, two, four or more for each line head 11C to 11K. Hereinafter, effects of the present invention are further described in detail with reference to examples.

EXAMPLE 1

The landing position deviation of the ejected ink from the recording heads 17*a*-17*c* of each line head 11C-11K of the printer 100 according to the present embodiment and the remaining of not-wiped ink are investigated. As a test method, in the printer 100 of line head type shown in FIG. 1, rubber blades having a rubber hardness of 40° and a thickness of 1.3 mm are used as the first wipers 35*a*1-35*c*1 and rubber blades having a rubber hardness of 60° and a thickness of 1.1 mm are used as the second wipers 35*a*2-35*c*2, which is called a present disclosure 1. Besides, the rubber hardnesses of the first wipers 35*a*1-35*c*1 and second wipers 35*a*2-35*c*2 are made to be the same as the present disclosure 1, and the thicknesses of the first wipers 35*a*1-35*c*1 and second wipers 35*a*2-35*c*2 are formed to be 1.1 mm, which is called a present disclosure 2.

On the other hand, rubber blades having a rubber hardness of 60° and a thickness of 1.1 mm are used as the first wipers 35*a*1-35*c*1 and rubber blades having a rubber hardness of 40° and a thickness of 1.3 mm are used as the second wipers 35*a*2-35*c*2, which is called a comparative example 1. Besides, rubber blades having a rubber hardness of 60° and a thickness of 1.1 mm are used as the first wipers 35*a*1-35*c*1 and second wipers 35*a*2-35*c*2, which is called a comparative example 2. Besides, rubber blades having a rubber hardness of 40° and a thickness of 1.3 mm are used as the first wipers 35*a*1-35*c*1 and second wipers 35*a*2-35*c*2, which is called a comparative example 3.

The recovery operation of the recording heads 17*a*-17*c* of each line head 11C-11K of the printer 100 in the present disclosures 1, 2 and comparative examples 1-3 is executed, then the landing position deviation of the ejected ink and the remaining of not-wiped ink are visually observed. As an evaluation method of the landing position deviation, the ink purge and wipe are repeatedly executed 22,000 rounds, landing position deviation amounts are measured every 2,000 rounds, and in a case where the maximum value of deviation increment amounts $\Delta 3\sigma$ from an initial landing position is under 5.0 μm, it is evaluated ○ (good), and in a case where the maximum value is 5.0 μm or larger, it is evaluated x (poor).

In the meantime, the level, in which the maximum value of the deviation increment amounts $\Delta 3\sigma$ is 5.0 μm, is a level in which a line is recognizable visually on a plain paper sheet in which the line is inconspicuous because the ink easily spreads on a sheet surface and even if the landing position deviation occurs, an adjacent dot compensates. Besides, as to the line heads 11C-11Y using the second wipers 35*a*2-35*c*2 for cyan, yellow, and magenta, in a case where any one of the line heads 11C-11Y has the landing position deviation of 5.0 μm or larger, it is evaluated x.

As an evaluation method of the remaining of not-wiper ink, in a case where the remaining of not-wiped ink does not occur during the wipe period of the purged ink, it is evaluated "Good", in a case where a line-like remaining slightly occurs in the movement direction (arrow CC' direction in FIG. 10) of the first wipers 35*a*1-35*c*1 or second wipers 35*a*2-35*c*2, it is evaluated "Not bad", and in a case where a line-like remaining occurs, it is evaluated "Poor". The results are shown in a table 1.

| | recording head | rubber hardness (°) | linear pressure (N/m) | landing position deviation: deviation amount (μm) | landing position deviation: evaluation | remaining of not-wiped ink | overall evaluation |
|---|---|---|---|---|---|---|---|
| present | black | 40 | 30 | 3.6 | Good | Not bad | Excellent |
| disclosure 1 | color | 60 | | 2.3 | Good | Good | |
| present | black | 40 | 20 | 3.5 | Good | Poor | Good |
| disclosure 2 | color | 60 | 30 | 2.2 | Good | Good | |
| comparative | black | 60 | 30 | 10.9 | Poor | Good | Poor |
| example 1 | color | 40 | | 2.1 | Good | Not bad | |
| comparative | black | 60 | | 10.9 | Poor | Good | Poor |
| example 2 | color | 60 | | 2.3 | Good | Good | |
| comparative | black | 40 | | 3.6 | Good | Not bad | Not bad |
| example 3 | color | 40 | | 2.1 | Good | Not bad | |

As apparent from the table 1, in the comparative example 1 in which the rubber hardness of the first wipers 35*a*-35*c* is 60° and the rubber hardness of the second wipers 35*a*2-35*c*2 is 40° and in the comparative example 2 in which the rubber hardnesses of the first wipers 35*a*1-35*c*1 and second wipers 35*a*2-35*c*2 are all 60°, the landing position deviation amount of the black ink ejected from the first recording heads 17*a*-17*c* of the line head 11K is larger than 5.0 μm after the ink purge and wipe are repeatedly executed, which is unusable as a product; accordingly, it is evaluated x.

On the other hand, comparing each of the present disclosures 1, 2 in which the rubber hardness of the first wipers 35*a*1-35*c*1 is 40° and the rubber hardness of the second wipers 35*a*2-35*c*2 is 60° with the comparative example 3 in which the rubber hardnesses of the first wipers 35*a*1-35*c*1 and second wipers 35*a*2-35*c*2 are all 40°, the landing position deviations are all evaluated "Good", but in the comparative example 3, the remaining of not-wiped ink occurs in both groups of the first recording heads 17*a*1-17*c*1 of the line head 11K and the second recording heads 17*a*2-17*c*2 of the line heads 11C-11Y; accordingly, the overall evaluation is "Not bad". Further, in the present disclosure 1, the remaining of not-wiped ink slightly occurs in only the first recording heads 17*a*1-17*c*1 of the line head 11K; accordingly, the overall evaluation is "Excellent", and in the present disclosure 2, the remaining of not-wiped ink occurs in only the first recording heads 17*a*1-17*c*1 of the line head 11K more remarkably than the present disclosure 1; accordingly, the overall evaluation is "Good".

From the above results, in the present disclosures 1, 2 in which the rubber hardness of the first wipers 35*a*1-35*c*1 is 40° and the rubber hardness of the second wipers 35*a*2-35*c*2 is 60°, it is confirmed that after the ink purge and wipe are repeatedly executed, it is possible to effectively alleviate the landing position deviation of the black ink ejected from the first recording heads 17*a*1-17*c*1 of the line head 11K and the remaining of not-wiped color ink in the second recording heads 17*a*2-17*c*2 of the line heads 11C-11Y. Further, in the present disclosure 1 in which the contact pressure of the first wipers 35*a*1-35*c*1 is 30 N/m, it is confirmed that it is possible to more effectively alleviate the remaining of not-wiped black ink of the first recording heads 17*a*1-17*c*1.

The present disclosure is usable for an ink-jet recording apparatus that performs recording by ejecting ink from a recording head. In the case where a plurality of water-based inks including black ink are used, the use of the present disclosure leads to an ink-jet recording apparatus that can effectively alleviate the scrape of a water-repellent film of an ink ejecting surface caused by a wipe blade and the remaining of not-wiped ink.

What is claimed is:

1. An ink-jet recording apparatus capable of executing a recovery operation of a recording head, comprising:

a plurality of recording heads each having an ink ejecting surface which is provided with a nozzle region where an ejecting nozzle for ejecting water-based ink onto a recording medium is opened and is provided thereon with a water-repellent film, includes a first recording head for ejecting black ink containing carbon black as colorant and a second recording head for ejecting color ink, other than the black ink, containing an organic pigment as colorant;

a wipe blade that is formed of rubber and wipes purged ink which is pushed out forcibly from the ejecting nozzle to the ink ejecting surface;

a drive mechanism that moves the wipe blade along the ink ejecting surface and is able to move-up/down the wipe blade in a direction in which to approach or leave the ink ejecting surface, wherein the wipe blade has:

a first wipe blade that wipes the purged ink which is pushed out to the ink ejecting surface of the first recording head; and a second wipe blade that wipes the purged ink which is pushed out to the ink ejecting surface of the second recording head;

the first wipe blade is lower than the second wipe blade in rubber hardness, and the rubber hardness of the first wipe blade is 30° or higher to 45° or lower in ASKER C hardness.

2. The ink-jet recording apparatus according to claim 1, wherein the rubber hardness of the second wipe blade is 50° or higher in the ASKER C hardness.

3. The ink-jet recording apparatus according to claim 1, wherein the first wipe blade is contacted on the ink ejecting surface with a contact pressure that is substantially equal to a contact pressure with which the second wipe blade is contacted on the ink ejecting surface.

4. The ink-jet recording apparatus according to claim 3, wherein the first wipe blade is larger than the second wipe blade in thickness.

5. The ink-jet recording apparatus according to claim 3, wherein the first wipe blade and the second wipe blade have each a proximal end portion supported by a wiper carriage that is movable along the ink ejecting surface and a tip end portion that contacts the ink ejecting surface, and the first wipe blade is shorter than the second wipe blade in a length from the proximal end portion to the tip end portion, and the first wipe blade and the second wipe blade are equal to each other in a height position of the tip end portion.

6. An ink-jet recording apparatus capable of executing a recovery operation of a recording head, comprising:

a plurality of recording heads each having an ink ejecting surface which is provided with a nozzle region where an ejecting nozzle for ejecting water-based ink onto a recording medium is opened and is provided thereon with a water-repellent film, includes a first recording head for ejecting black ink and a second recording head for ejecting color ink other than the black ink;

a wipe blade that is formed of rubber and wipes purged ink which is pushed out forcibly from the ejecting nozzle to the ink ejecting surface;

a drive mechanism that moves the wipe blade along the ink ejecting surface and is able to move-up/down the wipe blade in a direction in which to approach or leave the ink ejecting surface, wherein the wipe blade has:

a first wipe blade that wipes the purged ink which is pushed out to the ink ejecting surface of the first recording head; and a second wipe blade that wipes the purged ink which is pushed out to the ink ejecting surface of the second recording head;

the first wipe blade is lower than the second wipe blade in rubber hardness, and the rubber hardness of the first wipe blade is 30° or higher to 45° or lower in ASKER C hardness the first wipe blade is contacted on the ink ejecting surface with a contact pressure of 30 N/m or higher on the ink ejecting surface.

* * * * *